US005740508A

United States Patent [19]

Matsuura et al.

[11] Patent Number: 5,740,508

[45] Date of Patent: Apr. 14, 1998

[54] IMAGE FORMING APPARATUS INCLUDING TONER SCATTERING PREVENTION

[75] Inventors: Masahiko Matsuura, Suita; Eiichi Sano, Takatsuki, both of Japan

[73] Assignee: Minolta Co., Ltd., Osaka, Japan

[21] Appl. No.: 593,432

[22] Filed: Jan. 29, 1996

[30] Foreign Application Priority Data

Jan. 31, 1995 [JP] Japan ..... 7-014246

[51] Int. Cl.[6] ..... G03G 15/16

[52] U.S. Cl. ..... 399/308; 399/296; 399/312; 399/314; 399/390

[58] Field of Search ..... 399/302, 303, 399/308, 312, 314, 390, 66, 296; 430/126

[56] References Cited

U.S. PATENT DOCUMENTS

| | | | |
|---|---|---|---|
| 3,697,170 | 10/1972 | Bhagat et al. | 430/124 |
| 3,976,370 | 8/1976 | Goel et al. | 399/312 |
| 4,183,658 | 1/1980 | Winthaegen | 399/165 |
| 4,348,098 | 9/1982 | Koizumi | 399/296 |
| 4,931,839 | 6/1990 | Tompkins et al. | 399/66 |
| 4,984,025 | 1/1991 | Landa et al. | 399/308 |

*Primary Examiner*—Arthur T. Grimley
*Assistant Examiner*—Sophia S. Chen
*Attorney, Agent, or Firm*—Burns, Doane, Swecker & Mathis, LLP

[57] ABSTRACT

An image forming apparatus having a charger which applies a voltage of the same polarity as a toner image formed on an intermediate transfer member onto an upstream side of a first transfer portion at which the intermediate transfer member faces an image bearing member, as well as a transfer electrode which applies a bias voltage of an opposite polarity to the toner image onto a downstream side of the first transfer portion. On an upstream side of a second transfer portion at which the toner image formed on the intermediate transfer member is transferred by a transfer roller onto a transfer sheet with respect to a sheet transporting direction, a bias voltage applying device is provided which applies to the transfer sheet a voltage of an opposite polarity to the toner image and greater than a surface potential of the intermediate transfer member at the second transfer portion. At a position facing to the transfer roller through the intermediate transfer member, a voltage of an opposite polarity to the toner image is applied, and a recharger is provided which applies to the intermediate transfer member a voltage of the same polarity as the toner image on an upstream side of the second transfer portion.

13 Claims, 9 Drawing Sheets

IMAGE FORMING APPARATUS INCLUDING TONER SCATTERING PREVENTION

BACKGROUND OF THE INVENTION

1. Field of the Invention

The present invention relates to an image forming apparatus of an electrostatic latent image type such as electrophotographic copying machines, electrophotographic printers and the like.

2. Description of the Related Art

Conventionally, well-known image forming methods using an intermediate transfer member are used in image forming apparatuses which form images by forming an electrostatic latent image such as electrophotographic copying machine, electrophotographic printers and the like. In image forming methods using an intermediate transfer member, an image formed on an image-bearing member such as a photosensitive member, dielectric member or the like is transferred onto an intermediate transfer member in a primary transfer, and said image is transferred from said intermediate transfer member onto a transfer member such as a copy sheet, OHP transparency or the like in a secondary transfer. In such image forming methods, typically a transfer film having an intermediate resistance is used as an intermediate transfer member, and a transfer roller to which is supplied a transfer voltage is used for the secondary transfer. Deadspace is reduced by using an intermediate transfer film, thereby allowing a more compact apparatus design. Use of a transfer roller improves transfer efficiency and can reduce the amount of ozone generated, and can be used concomitantly as a transport roller for the transfer member. By providing an opposing roller of smaller diameter at a position opposite the transfer roller, the curvature separation can be used to separate the transfer member from the transfer film.

Furthermore, in addition to methods which form an image on an intermediate transfer film, are other conventional image forming methods wherein a transfer medium is supported on a transfer member, and an image is directly transferred onto said transfer member.

In image forming methods using an intermediate transfer film, however, in each process of the primary transfer and secondary transfer the so-called "pretransfer" phenomenon may occur. Pretransfer occurs in the primary transfer before the image-bearing member adheres to the intermediate transfer film due to the toner image on the surface of the image-bearing member flying in the direction of the intermediate transfer film. Pretransfer occurs in the secondary transfer before the intermediate transfer film adheres to the transfer member in the transfer region due to the toner on the surface of the intermediate transfer film flying to the transfer member. When pretransfer occurs, accurate transfer cannot be accomplished, and image defects occur such as airborne scattering wherein toner powder spatters around the characters.

Even in image forming methods wherein a transfer medium is maintained on a transfer member and the image is directly transferred to said transfer medium, pretransfer may occur in the same manner as in the primary transfer process in image forming methods using an intermediate transfer film, thereby producing image defects.

SUMMARY OF THE INVENTION

A main object of the present invention is to prevent the occurrence of image defects in image forming methods using an intermediate transfer film.

Another object of the present invention is to prevent pretransfer from occurring in each process of the primary transfer and secondary transfer in image forming methods using an intermediate transfer film.

A further object of the present invention is to prevent pretransfer from occurring in image forming methods wherein a transfer medium is supported on a transfer member and an image is directly transferred onto said transfer medium.

These and other objects of the present invention are accomplished by an image forming apparatus comprising an image bearing member, an image forming means for forming a toner image onto the image bearing member by powder toner, an intermediate transfer member facing to the image bearing member at a transfer portion, a first electrode which applies to the intermediate transfer member an electric potential having an opposite polarity to the polarity of the toner image formed on the image bearing member, and a second electrode provided on an upstream side of the transfer portion with respect to the movable direction of said intermediate transfer member to transfer the toner image onto a sheet, said second electrode applying to the intermediate transfer member an electric potential having the same polarity as the polarity of the toner image.

These and other objects of the present invention are also accomplished by an image forming apparatus comprising an image bearing member, an image forming means for forming a toner image onto the image bearing member, a transfer device for transferring the toner image formed on the image bearing member onto a transfer medium at a transfer portion, a transporting path for transporting the transfer medium to the transfer portion, and bias applying means provided on an upstream side of said transfer portion with respect to a direction of transportation of the transfer medium, said bias applying means applying to the transfer medium a voltage of the same polarity as the toner image as well as of higher potential than a surface potential of the image bearing member at the transfer portion.

These and other objects of the present invention are also accomplished by an image forming apparatus comprising, an image bearing member, an image forming means for forming a toner image onto the image bearing member, an intermediate transfer member, a first transfer device for transferring the toner image formed on the image bearing member to the intermediate transfer member at a transfer portion, a second transfer device for transferring the toner image transferred on the intermediate transfer member onto a transfer medium, a first bias voltage applying means facing the second transfer device through the intermediate transfer member, the first bias voltage applying means applying to the intermediate transfer device a voltage of a polarity opposite to the polarity of toner image, and a second bias voltage applying means for applying to said second transfer device a voltage of the polarity opposite to the polarity of toner image and at least 800 V greater than the bias voltage applied by said first bias voltage applying means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
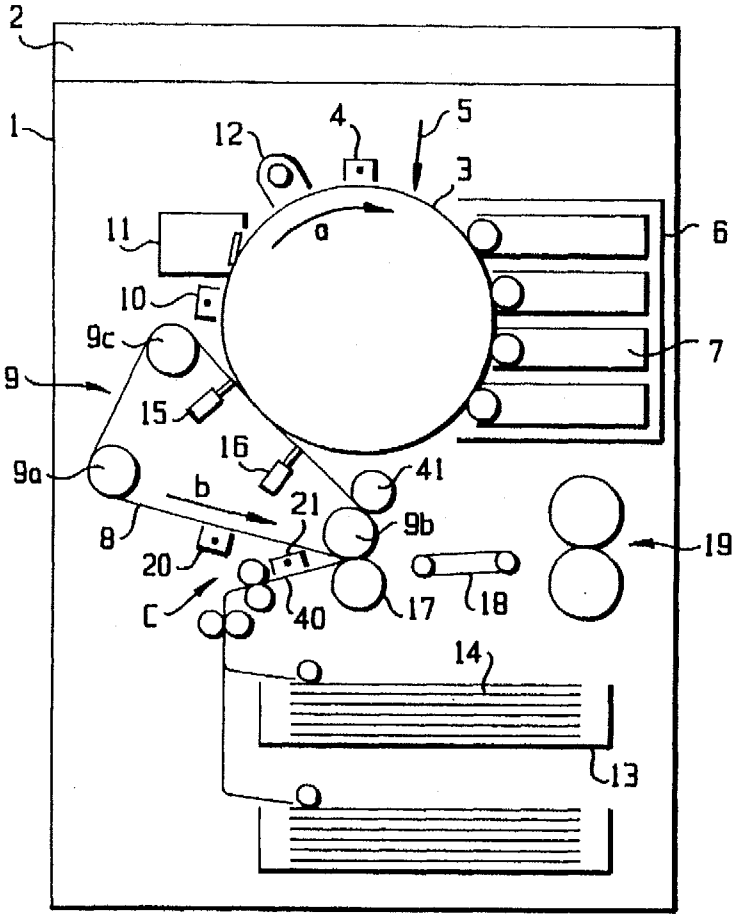
FIG. 1 is a section view showing an embodiment of the image forming apparatus of the present invention.

FIG. 1 briefly shows the construction of image forming apparatus 1 of the present invention. The image forming apparatus 1 of the present invention is an electrophotographic type image forming apparatus such as used in copying machines, printers and the like.

Image forming apparatus 1 is provided with an image-bearing member 3 comprising an organic photosensitive member (OPC), and arranged around the periphery of said image-bearing member 3 are charger 4, developing unit 6, intermediate transfer device 9, cleaning pre-charger 10, cleaner 11, image forming elements such as eraser 12 and the like, and image reader 2, paper supply device 13, conveyor belt 18, fixing roller 19 and other elements. Sheets 14 such as copy paper sheets, overhead projector (OHP) transparencies and the like are stacked in paper supply device 13 which transports said sheets in the arrow C direction with a predetermined timing. An inorganic photosensitive member or other type of image-bearing member may be used alternatively to the organic photosensitive member (OPC) used as image-bearing member 3.

Image-bearing member 3 is rotated in the arrow a direction, and uniformly charged to a predetermined potential by charger 4. Image reader 2 reads the original document image, and transmits the read data to a laser generator not shown in the drawing. The laser generator optically exposes image-bearing member 3 via exposure unit 5 so as to form an electrostatic latent image thereon based on the read data transmitted from the image reader 2. The aforesaid electrostatic latent image is developed by one of four developing devices 7 provided in developing unit 6. Yellow, magenta, cyan, and black color toners are individually accommodated in the four developing devices 7. Each toner is a negative polarity toner typically used for reverse development, said toners being charged with a negative polarity within developing devices 7. Although a positive polarity toner may be used in accordance with the image forming method, the polarity used for charging and transfer and the like, as well as image forming method must be changed in accordance with the polarity of the toner. The toner image formed on the image-bearing member 3 is transferred in a primary transfer to an intermediate transfer film 8 of intermediate transfer device 9. On the other hand, the residual toner image remaining on image-bearing member 3 is removed by cleaner 11 after being discharged by cleaning pre-charger 10. After the residual toner is removed by cleaner 11, the residual charge remaining on image-bearing member 3 is eliminated by eraser 12, and the next image forming cycle is entered. Although optical exposure is accomplished by a laser generator in the present embodiment, other optical exposure devices such as LED, exposure lamp or the like alternatively may be used.

Intermediate transfer device 9 comprises three support rollers 9*a*, 9*b*, 9*c* which support intermediate transfer film 8. Arranged around the periphery of transfer film 8 are various types of elements such as a transfer brush 15, feeder brush 16, transfer roller 17, pretransfer charger 20, intermediate transfer film cleaner 41. Intermediate transfer film 8 is a film formed of a conductive carbon dispersed in polycarbonate, ETFE, polyimide, fluoro resin or the like, has a surface resistance with an intermediate resistance value of $10^6$~$10^{10}$ Ω, and a thickness of 50~250 μm. An intermediate transfer film of this structure is suitable for use as an intermediate transfer member because it allows current to readily flow through the film, and provides excellent transfer efficiency.

A transfer bias voltage having a polarity opposite the polarity of the toner image formed on the image-bearing member is applied to the back side of intermediate transfer film 8 by transfer brush 15. The toner image is transferred in a primary transfer process from image-bearing member 8 to the intermediate transfer film 8 by means of the action of said transfer bias voltage. Transfer brush 15 comprises bundles of stainless steel or carbon fibers sandwiched between aluminum plates, and has a volume resistivity of less than $10^6$ Ω. The transfer brush has a simple structure, and is suitable for intermediate transfer film transfers due to the homogeneity of the imparted charge. Alternatively, the transfer brush may have carbon mixed in fibers of rayon, nylon or the like to adjust the resistance value. A conductive film, blade, roller or the like alternatively may be used in place of the brush.

A feeder brush 16 is disposed upstream from the primary transfer region of intermediate transfer film 8. The material and construction of feeder brush 16 is identical to that of transfer brush 15, but the applied bias voltage has a polarity opposite the polarity of the transfer bias voltage applied to transfer brush 15.

Figure 2:
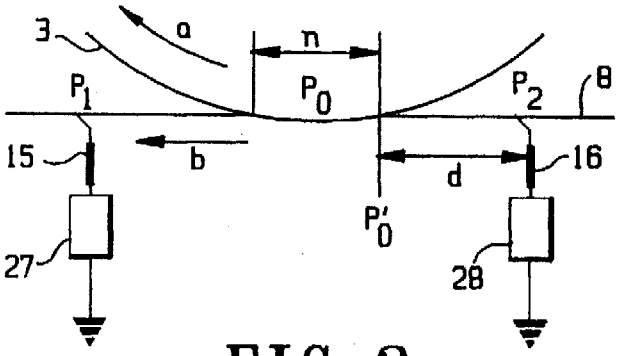
FIG. 2 is an enlargement of the essential portion of the primary transfer region of the image forming apparatus of the present invention.
Figure 3:
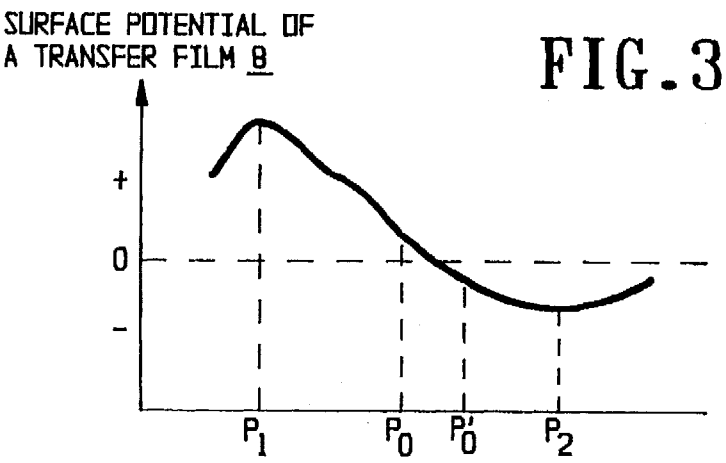
FIG. 3 is a graph showing the surface potential distribution on the transfer film in the vicinity of the primary transfer region of the image forming apparatus of the present invention.

FIG. 2 shows details of the construction of transfer brush 15 and feeder brush 16 of the present embodiment. FIG. 3 is a graph showing the change in the surface potential of intermediate transfer film 8 in the construction shown in FIG. 2. In the construction of FIG. 2, n is the primary transfer region abutting image-bearing member 3 and intermediate transfer film 8, and Po is the position at the center of primary transfer region n. Transfer brush 15 is provided at a position corresponding to the aforesaid primary transfer region n, or at a position P1 which is on the downstream side from said position n. A transfer bias voltage is applied to transfer brush 15 by a primary transfer bias power source 27; the position P1 of transfer brush 15 and the transfer bias voltage are set so as to provide a suitable transfer potential at primary transfer region n.

A feeder brush 16 is disposed at position P2 upstream from the primary transfer region n; feeder brush 16 applies a bias voltage having a polarity opposite the polarity of the transfer bias voltage. Intermediate transfer film 8 has an intermediate resistance due to the difficulty in maintaining transfer characteristics with a high resistance value. Since intermediate transfer film 8 has an intermediate resistance, the surface potential of said intermediate transfer film 8 in the vicinity of primary transfer region n has positive polarity at position P1 and negative polarity at position P2, as shown in FIG. 3, such that the polarities are reversed in the region between positions P1 and P2. It can be understood from FIG. 3 that the elevation in potential produced by the transfer bias voltage peaks at position P1 of the transfer brush 15 and extends to the primary transfer region n. Accordingly, the polarity and potential of intermediate transfer film 8 in the primary transfer region n at this time is set so as achieve a positive charge potential suitable for transfer at least at the trailing edge. The polarity and potential of intermediate transfer film 8 is set by the transfer bias voltage applied to transfer brush 15 and position P1 of said transfer brush 15, and the feeder bias voltage applied to feeder brush 16 and the position P2 of said feeder brush 16. Thus, the force pulling toner image on the intermediate transfer film 8 can be nullified by feeder brush 16 which applies a bias voltage having the same polarity as the toner image formed on image-bearing member 3, said bias application being on the upstream side from primary transfer region n of intermediate transfer film 8. By eliminating the force attracting the toner image on intermediate transfer film 8, airborne toner dispersion and image defects caused by said airborne toner dispersion can be prevented. It is desirable that the transfer bias voltage and feeder bias voltage produce a surface potential of zero or a polarity identical to that of the toner at the extreme upstream location of primary transfer region n, i.e., at the position Po' marking the start of contact between image-bearing member 3 and intermediate transfer film 8. Especially, when the surface potential at the position Po' is 0—200 V, toner airborne dispersion is minimized and excellent transfer is achieved.

Since intermediate transfer film 8 has an intermediate resistance, the surface potential of intermediate transfer film 8 becomes lower moving away from the points of bias voltage applications by transfer brush 15 and feeder brush 16. Accordingly, when the position of feeder brush 16 is too distant from the primary transfer region n, the surface potential of Po' is lowered, thereby reducing effectiveness in preventing pretransfer. When the bias voltage applied to feeder brush 16 is increased too far in order to maintain the surface potential at Po', adverse effects occur which include deterioration of intermediate transfer film 8.

On the other hand, when the position of transfer brush 15 is set too far from the primary transfer region n, the surface potential of Po is lowered, thereby reducing transfer efficiency. When the bias voltage applied to transfer brush 15 is raised in order to maintain the surface potential at Po, there is an increase in the amount of current that flows through intermediate transfer film 8 from primary transfer bias power source 27 to feeder bias power source 28. When the amount of said current flow becomes excessive, there is concern about damage to said primary transfer bias power source 27 and feeder bias power source 28.

Conversely, when the position P2 of feeder brush 16 is too near the primary transfer region n, either the feeder bias voltage applied to said feeder brush 16 must be weakened, or the potential of the transfer bias voltage applied to transfer brush 15 must be increased in order to maintain the surface potential of Po. When the feeder bias voltage applied to feeder brush 16 is excessively weakened, the effectiveness in preventing pretransfer is reduced, whereas when the transfer bias voltage is increased, there is concern about damage to primary transfer bias power source 27 and feeder bias power source 28.

When transfer brush 15 is disposed at Po' at the upstream portion of primary transfer region n, the transfer electric field reaches the upstream portion of primary transfer region n. When the transfer electric field reaches the upstream portion of primary transfer region n, the potential of Po' is zero or it becomes difficult to attain a potential of the same polarity as the toner even when the bias voltage is increased to feeder brush 16. Thus, transfer brush 15 is preferably disposed downstream from the position of Po'.

It is desirably that feeder brush 16 and transfer brush 15 are respectively disposed at the upstream and downstream portions of primary transfer region n so as to be separated by a predetermined distance. The nip of primary transfer region n can be broadened by means of the aforesaid brush placements. When the nip of primary transfer region n can be broadened, transfer efficiency is improved and the region of inverse potential can be broadened to allow greater latitude in settings. Broadening the nip region reduces the extent to which the position of inverse potential protrudes from the nip region even when the position of inverse potential moves due to change of transfer efficiency caused by the change of temperature or humidity, or due to deterioration of the transfer brush or intermediate transfer film. Thus, the effectiveness of preventing pretransfer can be stabilized.

Experiments were performed using the image forming apparatus 1 of the present embodiment, and it was found that there was no airborne toner dispersion in the primary transfer region and excellent images were obtained when the surface resistance of intermediate transfer film was $10^7$~$10^9$ Ω, the distance d between Po' marking the start of contact between image-bearing member 3 and intermediate transfer film 8 and the feeder brush position P2 was d=5~40 mm, and preferably 5~25 mm, the bias voltage applied to transfer brush 15 was +500~3,000 V, and preferably +1,000~2,500 V, and the bias voltage applied to feeder brush 16 was −1,000—2,000 V. At this time, the load on the transfer device including primary transfer bias power source 27 and feeder bias power source 28 was controlled to minimum limits.

When images of a plurality of colors are formed after the primary transfer is completed, a developing device 7 is selected for use in development for each image formation, and toner images of different colors are formed on image-bearing member 3. These toner images are sequentially transferred onto intermediate transfer film 8, such that a number of images are overlaid one upon another as required for the image being formed.

In typical full color image formation, yellow, magenta, cyan, and black images are overlaid on intermediate transfer film 8. When the image overlays on intermediate transfer film 8 are completed, then a secondary transfer is accomplished by transporting a sheet 14 fed from sheet supply device 13 in the arrow C direction with a synchronized timing.

Figure 4:
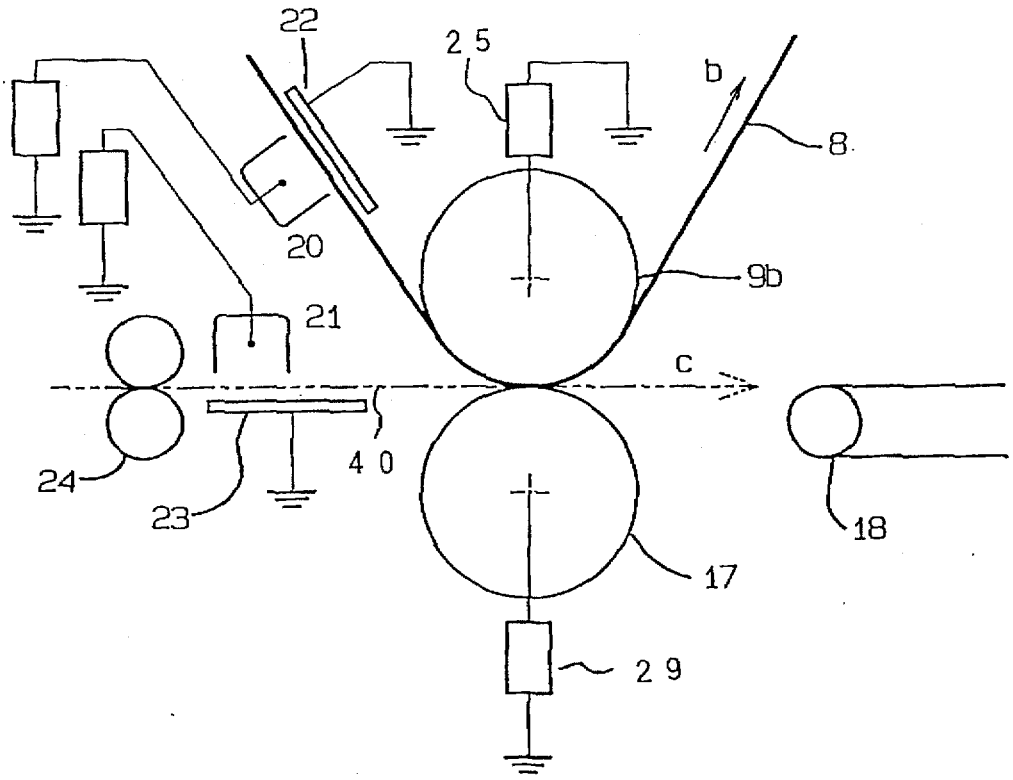
FIG. 4 is an enlargement of the essential portion of the secondary transfer region of the image forming apparatus of the present invention.

FIG. 4 is an enlargement showing the secondary transfer region of the present embodiment. The secondary transfer region mainly comprises transfer roller 17, secondary transfer bias power source 29 for applying a transfer bias voltage to the transfer roller, support roller 9b which presses against transfer roller 17 through intermediate transfer film 8, and opposing bias power source 25 for applying to support roller 9b an opposing bias voltage having the same polarity as transfer roller 17. A pretransfer charger 20 is disposed at an upstream position of the secondary transfer region of intermediate transfer film 8, and a grounded conductive member 22 is provided opposite said pretransfer charger 20 so as to circumscribe intermediate transfer film 8 in order to increase the charging efficiency of the pretransfer charger with respect to the toner image. On the other hand, a sheet charger 21 is provided at an upstream position of the secondary transfer region of sheet transport path 40, and a grounded conductive member 23 is provided at a position opposite sheet charger 21 in order to improve the effectiveness of said sheet charger 21.

The toner image transferred to intermediate transfer film 8 in the primary transfer is transported from the primary transfer region to the secondary transfer region in accordance with the movement of intermediate transfer film 8 in the arrow b direction. The charge potential of the toner image transferred to intermediate transfer film 8 in the primary transfer is reduced during the movement from the primary transfer region to the secondary transfer region due to the intermediate resistance of intermediate transfer film 8. Particularly when color images are formed, the time required to finally reach the secondary transfer region is quite long due to the plurality of repeated image formations and primary image transfers, such that the charge potential of the toner image is thereby reduced. Pretransfer charger 20 increases the reduced toner potential and prevents the reduction of transfer characteristics by again charging the toner image on the intermediate transfer film 8.

The relationships among the voltage applied to pretransfer charger 20, the surface potential of intermediate transfer film 8, and transfer characteristics were tested in experiments, and the results are shown in Table 1.

TABLE 1

| Output of pretransfer charger 20 | Surface potential of intermediate transfer film 8 | Transfer characteristics |
|---|---|---|
| −1000 V | −300 V | x |
| −2000 V | −800 V | Δ |
| −3000 V | −1300 V | ○ |
| −4000 V | −1600 V | ◎ |

x: Not effective
Δ: Slightly effective
○: Effective
◎: Very effective

It can be understood from the experimental results that transfer characteristics improve when the output of pretransfer charger 20 is −2,000 V or higher, and preferably −3,000 V or higher.

Then, sheet 14 transported from sheet transport path 40 in the arrow C direction was fed to the secondary transfer region synchronously with the toner image formed on intermediate transfer film 8. Sheet 14 is transported to the area opposite sheet charger 21 provided at the upstream portion of the secondary transfer region of transport path 40, and charged with a negative polarity. The voltage applied to sheet charger 21 is set so as to be equal to or greater than the potential of the area of intermediate transfer film 8 opposite said sheet 14. A grounded conductive member 23 is provided opposite sheet charger 21. Sheet 14 can be charged with excellent efficiency because it passes through the electric field formed by conductive member 23 and sheet charger 21. In this way, the portion of sheet 14 protruding into the secondary transfer region has a negative polarity identical to the polarity of the toner image. Therefore, at a position upstream from the secondary transfer region, the electric field of the toner moving in the direction of sheet 14 is eliminated, thereby suppressing airborne toner dispersion caused by pretransfer.

Experiments were performed using the image forming apparatus 1 of the present embodiment, and image having excellent transfer characteristics without airborne toner dispersion were obtained when the toner was charged with a negative polarity, the surface resistance of intermediate transfer film was $10^8$ Ω, a primary transfer was accomplished by a predetermined process, the voltages applied to pretransfer charger 20 and sheet charger 21 were each −3,000 V, and the voltage applied to transfer roller 17 was −1,500~2,000 V.

Table 2 shows the relationship between sheet charger 21 and airborne dispersion during experiments in which the voltage applied to pretransfer charger 20 was fixed at −3,000 V.

Table 2

| Output of sheet charger 21 | Surface potential of sheet 14 | Airborne dispersion |
|---|---|---|
| −1000 V | −800 V | x |
| −2000 V | −1800 V | Δ |
| −3000 V | −2500 V | ○ |
| −4000 V | −3300 V | ○ |

x: Not effective
Δ: Slightly effective
○: Effective
◎: Very effective

It is clear from the data included in the experiment that airborne dispersion is suppressed when the relationship between the surface potential Vs of sheet 14 and the surface potential Vt of the intermediate transfer film is such that $$|Vs|>|Vt|$$

In order to simplify the construction of the apparatus, the surface potential (Vt) of intermediate transfer film 8 is set as the voltage Vt applied to the charger 20 when such is provided, and the surface potential (Vs) of sheet 14 is set as the voltage applied to sheet charger 21. When charger 20 is not provided, the surface potential (Vt) of intermediate transfer film 8 may be set as the voltage applied to transfer brush 15 or, to make more suitable value, as a value obtained by correcting the voltage applied to transfer brush 15 in consideration of the reduction of the potential to the secondary transfer region. The surface potential (Vs) of sheet 14 and the surface potential (Vt) of intermediate transfer film 8 may be measured by surface potential sensors so as to maintain a suitable correction value in accordance with changes in the surface potential of intermediate transfer film 8.

An opposing bias voltage of a polarity opposite that of the toner image adhered to intermediate transfer film 8 is applied to support roller 9b. The toner image is attracted in the direction of support roller 9b by means of the electrostatic action of the opposing bias voltage. Accordingly, the toner image is adhered to intermediate transfer film 8, thus suppressing airborne dispersion of the toner toward sheet 14 at the upstream portion of the secondary transfer region. In the present embodiment, an opposing bias voltage is applied to support roller 9b to allow more compact and efficient design of the intermediate transfer device 9. Therefore, the secondary transfer is accomplished by the action of the difference in potential of the bias voltages applied to transfer roller 17 and support roller 9b, and the pressure force between said transfer roller 17 and support roller 9b. The absolute value of the transfer bias voltage applied to the transfer roller must be a value greater than the absolute value of the opposing bias voltage applied to support roller 9b by the value of the potential difference required for transfer.

In experiments using the image forming apparatus 1 of the present embodiment, images were obtained having excellent transfer characteristics without airborne dispersion when the toner used had a negative charge polarity, the surface resistance of the intermediate transfer film 8 was $10^8$ Ω, the primary transfer was accomplished in the predetermined process, the voltage applied to pretransfer charger 20 and transfer roller 17 was +1,500~2,000 V, and the voltage applied to support roller 9b was +1,000 V.

Table 3 shows the relationships among transfer roller 17, the voltage applied to support roller 9b, and airborne dispersion, and transfer characteristics.

TABLE 3

| Output of transfer roller 17 | Voltage applied to support roller 9b | Airborne dispersion | Transfer characteristics |
|---|---|---|---|
| +1500 V | +500 V | Δ | Δ |
| +1500 V | +1000 V | ○ | x |
| +2000 V | +500 V | Δ | ○ |
| +2000 V | +1000 V | ○ | Δ |

x: Not effective
Δ: Slightly effective
○: Effective
◎: Very effective

Figure 5:
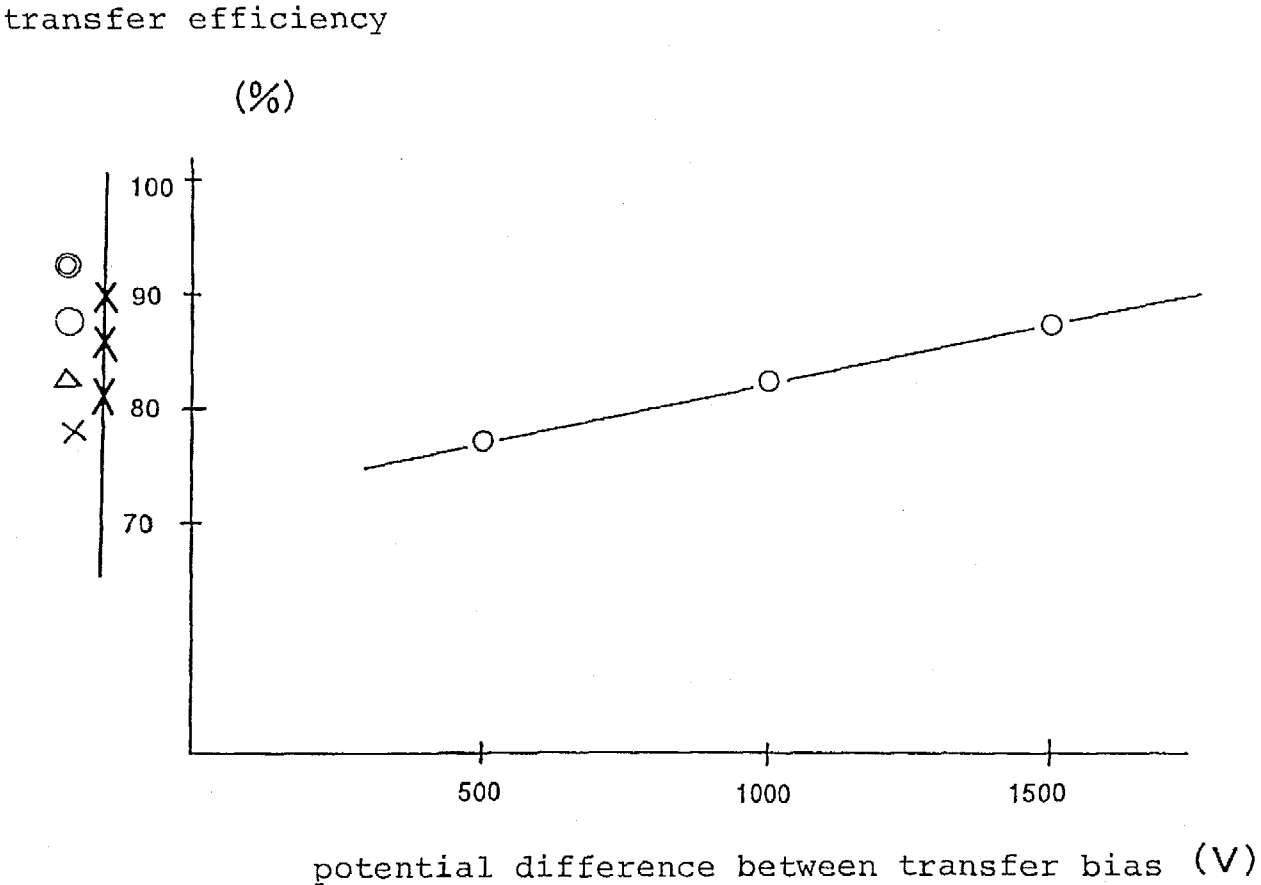
FIG. 5 is a graph showing the relationship between transfer efficiency and the difference in potential of the transfer bias voltage and the opposing bias voltage.

FIG. 5 is a graph showing the relationship between transfer efficiency and the difference in potential between the transfer bias voltage and the opposing bias voltage based on the experimental results which include the aforesaid data. It can be understood from the aforesaid graph that as the difference in potential between the transfer bias voltage and the opposing bias voltage increases, better transfer efficiency is attained. When the transfer bias voltage is set so as to be 800 V or more higher than the opposing bias voltage, transfer efficiency of 80% or higher (Δ: "Slightly effective" or greater) is attained, and adequate transfer characteristics can be obtained.

It can further be understood from Table 3 that when the opposing bias voltage is 500 V or higher, airborne dispersion prevention effect is obtained, and when set at 1,000 V or higher the highest degree of effectiveness in preventing airborne dispersion is obtained.

On the other hand, when the opposing bias voltage is 2,000 V or higher, adverse affects occur which include said opposing bias voltage flowing through intermediate transfer film 8 to the primary transfer member and other support rollers and the like; it is therefore desirable that the opposing bias voltage be less than 2,000 V. When the transfer bias voltage is 4,000 V or more, adverse affects occur which include air discharge of the transfer bias voltage from transfer roller 17 toward the transfer member and adjacent devices, as well as damage to the intermediate transfer film 8 and transfer roller 17 which adversely affect the image; therefore, it is desirable that the transfer bias voltage is less than 4,000 V.

Accordingly, a compact and efficient transfer device having excellent transfer characteristics and which does not produce airborne dispersion can be obtained by providing an opposing bias voltage device for applying a potential of a polarity opposite that of the toner of 500 V or more, and preferably 1,000 V or more but less than 2,000 V at a position opposite the transfer roller through intermediate transfer film 8, and applying to the transfer roller a potential 800 V or more greater than the potential application of the bias voltage device but less than 4,000 V.

Table 4 shows the relationships among the voltages applied to support roller 9b and transfer roller 17, airborne dispersion, and transfer characteristics in experiments wherein the pretransfer charger 20 was supplied a fixed voltage of 3,000 V.

TABLE 4

| Output of transfer roller 17 | Voltage of support roller 9b | Airborne dispersion | Transfer characteristics |
|---|---|---|---|
| +1500 V | +500 V | ○ | ○ |
| +1500 V | +1000 V | ◎ | Δ |
| +2000 V | +500 V | ○ | ◎ |
| +2000 V | +1000 V | ◎ | ○ |

x: Not effective
Δ: Slightly effective
○: Effective
◎: Very effective

As can be readily understood from the result shown in Table 4, airborne dispersion can be adequately prevented by using pretransfer charger 20 and minimizing the difference between the absolute value of the potential of the bias voltage applied to support roller 9b and the absolute value of the transfer potential, and minimizing the value of the potential of the bias voltage applied to support roller 9b. When the toner image is recharged, the adhesion force of the toner image toward the intermediate transfer member 8 increases so as to increase the effectiveness in preventing airborne dispersion, and the attractive force of the transfer roller 17 with respect to the toner image is also increased so as to improve the transfer efficiency.

Effectiveness in preventing airborne dispersion and obtaining excellent transfer characteristics is greatest when the output of pretransfer charger 20 is −2,000 V or more, and preferably −3,000 V or more.

The above-described experimental results verified that airborne dispersion can be effectively prevented by applying to the support roller 9b a voltage of the same polarity as the transfer bias voltage. It was further verified that prevention of airborne dispersion can be improved by charging the toner image before transfer with a polarity identical to the toner image polarity by means of pretransfer charger 20.

After the secondary transfer, sheet 14 is separated from intermediate transfer film 8 via curvature separation. After separation of sheet 14, the residual toner remaining on the surface of intermediate transfer film 8 is removed by intermediate film cleaner 41 in preparation for the next image formation. Sheet 14, which has been separated from intermediate transfer film 8, is transported to fixing device 19 via conveyor belt 18. After the toner image is fixed by fixing device 19, sheet 14 is discharged from the apparatus.

Figure 6:
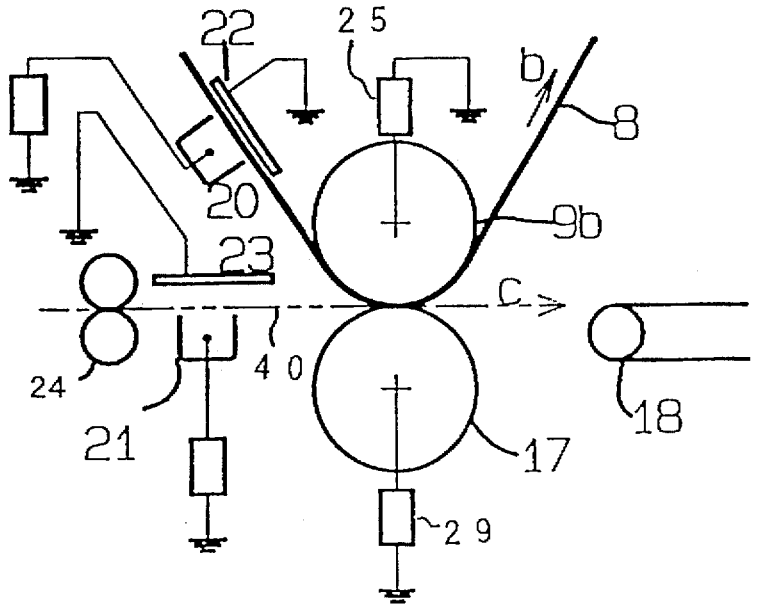
FIG. 6 is an enlargement of the essential portion of a modification of the secondary transfer region of the image forming apparatus of the present invention.

FIGS. 6~9 show the various conditions of the secondary transfer region. FIG. 6 shows the arrangement of sheet charger 21 opposite the back surface of sheet 14, suitable for applying a high voltage.

Figure 7:
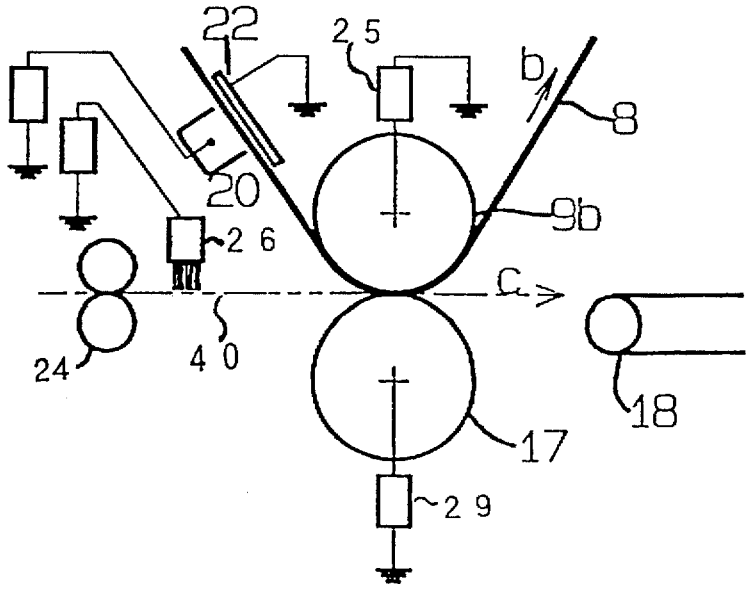
FIG. 7 is an enlargement of the essential portion of a modification of the secondary transfer region of the image forming apparatus of the present invention.
Figure 8:
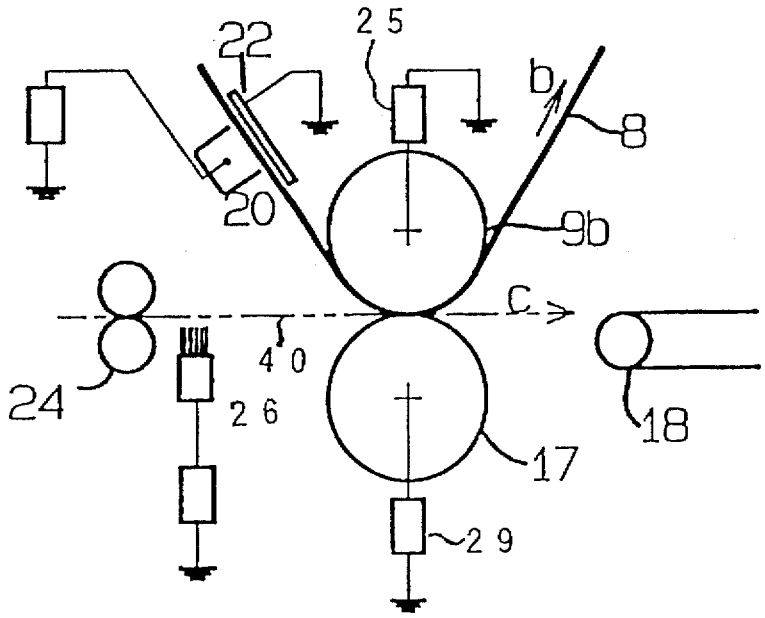
FIG. 8 is an enlargement of the essential portion of a modification of the secondary transfer region of the image forming apparatus of the present invention.

FIG. 7 shows the use of a conductive brush 26 as a charging member for charging the surface of sheet 14. Conductive brush 26 is constructed of bundled stainless steel, or carbon fibers sandwiched between aluminum plates, and has a volume resistivity of less than $10^6$ Ωcm. Alternatively, carbon may be mixed in rayon or nylon fibers to adjust the resistance to a suitable value. Similarly, when a conductive brush is used as the charging member for charging the surface of sheet 14, charging efficiency is improved and ozone generation is reduced because sheet 14 is directly charged. Conductive brush 26 is capable of imparting q charge without disturbing the front side of sheet 14 via placement in contact with the back side of sheet 14, as shown in FIG. 8.

Figure 9:
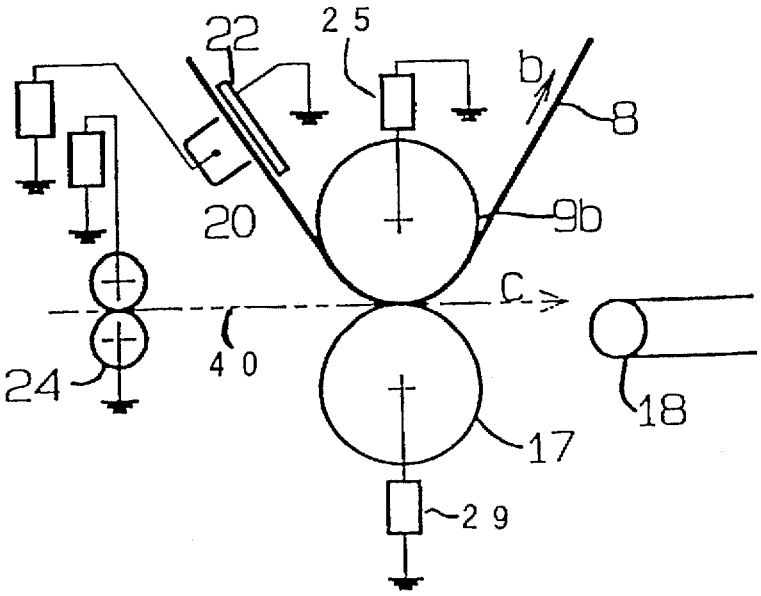
FIG. 9 is an enlargement of the essential portion of a modification of the secondary transfer region of the image forming apparatus of the present invention.

FIG. 9 shows an example of a combined charging member for charging the back surface of sheet 14 and a timing roller for feeding sheet 14. In this example, timing roller 24 is a semiconductor roller having a volume resistivity of $10^8$~$10^{10}$ Ωcm. In this instance, the combination of the charging member and timing roller simplifies the construction and reduces the number of components. Alternatively, timing roller 24 and a charging roller may be separately provided.

Figure 10:
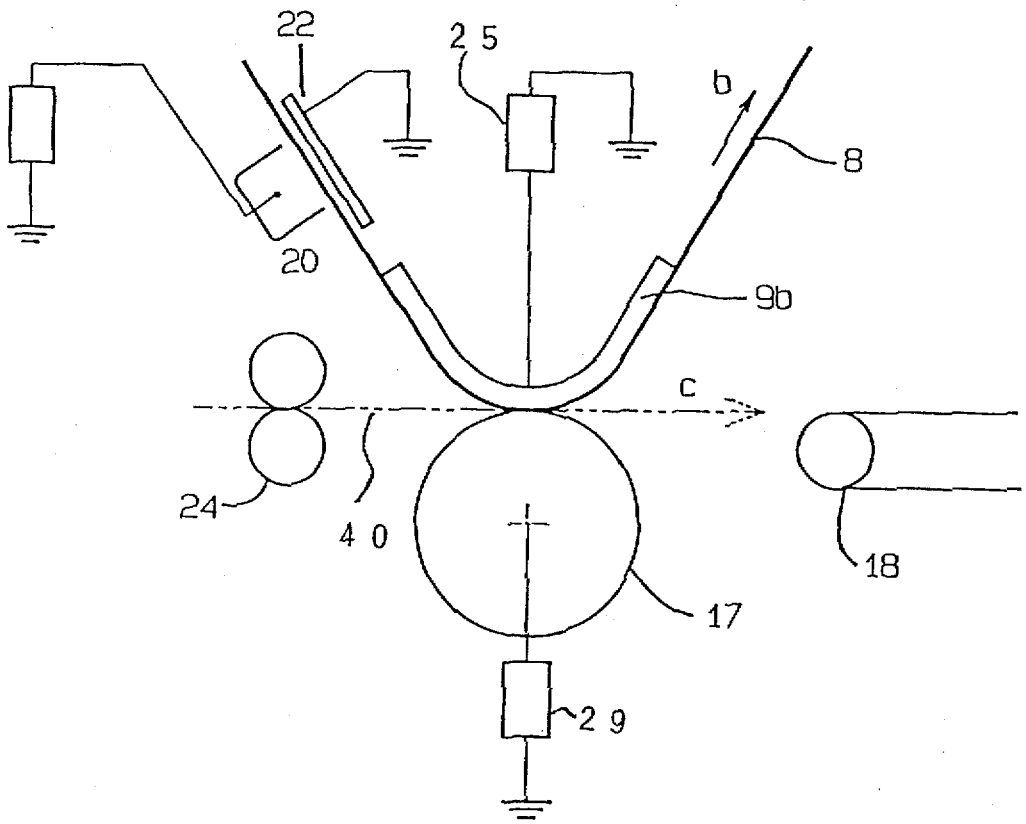
FIG. 10 is an enlargement of the essential portion of a modification of the secondary transfer region of the image forming apparatus of the present invention.

FIG. 10 shows the use of a plate-like member having conductive or semiconductive properties substituted for the application of a bias voltage to support roller 9*b*. Thus, the plate becomes the opposing electrode and allows the shape of the nip of the secondary transfer region to be freely set.

Figure 11:
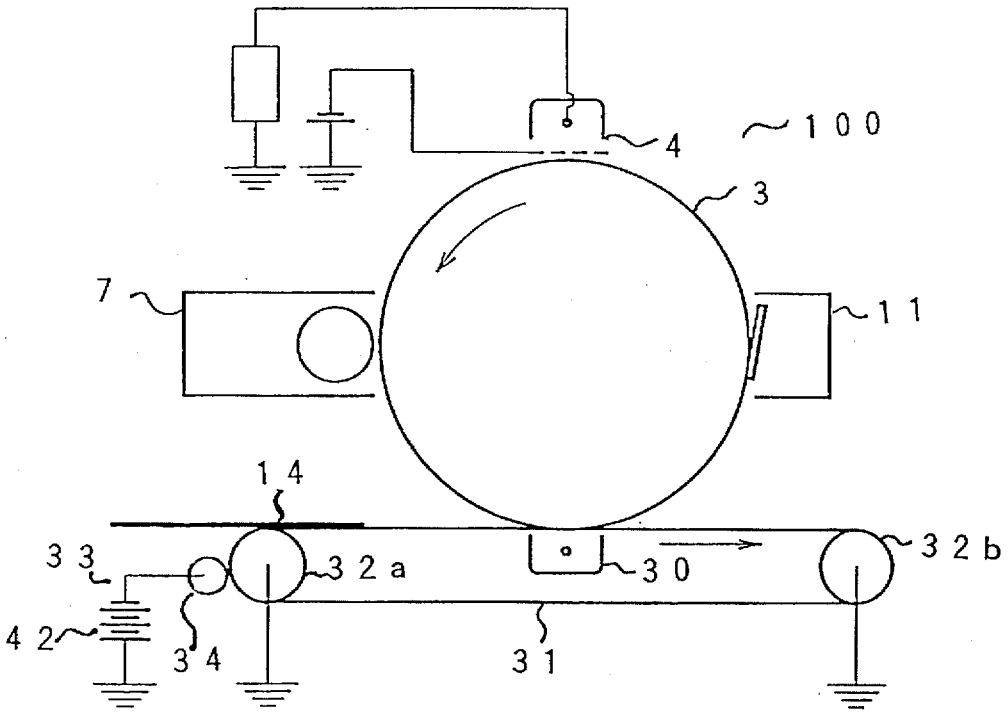
FIG. 11 is a section view of a modification of the image forming apparatus of the present invention.
Figure 12:
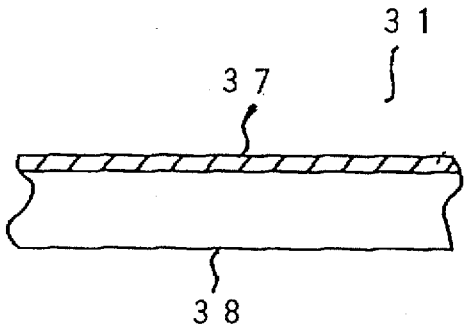
FIG. 12 is a partial section view of the transfer belt of a modification of the image forming apparatus of the present invention.

FIG. 11 shows image forming apparatus 100 which is a modification of image forming apparatus 1. Image forming apparatus 100 mainly comprises an image-bearing member 3, around which are disposed a charger 4, developing device 7, cleaner 11, and transfer belt 31 provided with an built in transfer charger 30. Transfer belt 31 is supported by two support rollers 32*a* and 32*b*, and unlike image forming apparatus 1, transports sheet 14 to the transfer region without bearing the toner image. Thus, transfer belt 31 has a dual layer construction comprising an insulation layer 37 and a conductive layer 38, as shown in FIG. 12, such that sheet 14 is adhered by the electrostatic content of the transfer belt. Insulation layer 37 is formed of PFT, PVDF or the like having a volume resistivity of $10^{14}$ Ω or more and a thickness of 20~70 μm, and preferably 30~50 μm. Conductive layer 38 is formed of PC, PVDF, vinyl chloride or the like having a volume resistivity of $10^2$~$10^{10}$ Ω or more and a thickness of 100~300 μm, and preferably 150~200 μm. The electrostatic content can be increased by reducing the thickness of insulation layer 37 so as to improve the adhesion force.

Figure 13:
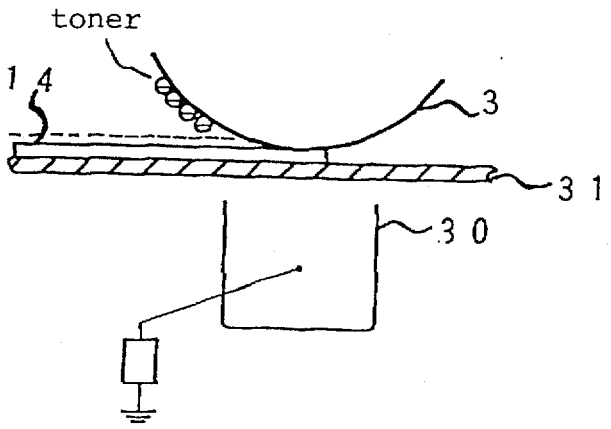
FIG. 13 is an illustration of the transfer region of a modification of the image forming apparatus of the present invention.

In the present embodiment, instead of sheet charger 21 provided in image forming apparatus 1, a charging device 33 is provided to charge sheet 14 with a polarity identical to that of the toner image to prevent pretransfer. Charging device 33 mainly comprises a charging roller 34, and charging roller power source 42. Charging roller 34 is disposed opposite transfer belt 31 upstream from the adhesion region of sheet 14, and is supplied a bias voltage of negative polarity from charging roller power source 42. Thus, the insulation layer 37 of transfer belt 31 is charged to a negative polarity identical to that of the toner image. The negative charge maintained on insulation layer 37 is charged to a negative polarity at the same time sheet 14 is adhered to transfer belt 31. The voltage applied to transfer belt 31 by charging roller 34 is set so as to be greater than the potential of the image-bearing member 3. Therefore, the negatively charged sheet 14 electrostatically repels the toner which has the/same polarity , as shown in FIG. 13, thereby preventing pretransfer. The potential of the image-bearing member 3 uses the voltage Vg of charger 4 as the surface potential of image-bearing member 3 immediately in front of the transfer region in order to simplify construction, but a corrected value obtained by calculating the decay in potential from the charging region to the transfer region may be used to improve accuracy. The potential of image-bearing member 3 may be a suitable voltage corresponding to fluctuations in the surface potential of image-bearing member 3 by using a surface potential sensor or the like.

Excellent images can be obtained if the voltage applied to the transfer belt is −1,000 V or more when the application voltage of charger 4 is Vg=−400~1,000 V.

Figure 14:
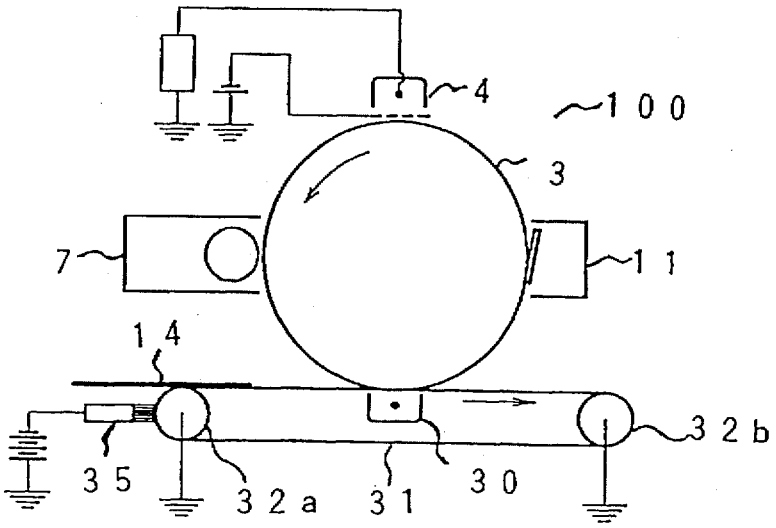
FIG. 14 is a section view of a modification of the image forming apparatus of the present invention.
Figure 15:
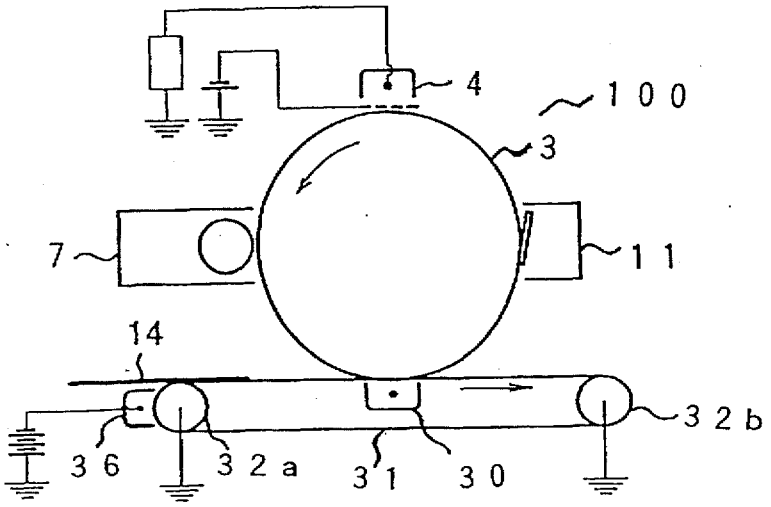
FIG. 15 is a section view of a modification of the image forming apparatus of the present invention.

The charging brush 35 of FIG. 14 may be substituted for the charging roller 34 as the charging device for transfer belt 31. The construction of the charging device can be simplified even more by using a charging brush as the charging device for transfer belt 31. As shown in FIG. 15, even higher voltage potentials are possible when a corona charger 36 is used as the charging device for transfer belt 31.

The present invention is not limited to image forming apparatus of the electrophotographic type, and may be in image forming apparatus of types which develop electrostatic latent images by toner and transfer same such as multi-stylus type and ion flow type.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an image bearing member;

an image forming means for forming a toner image onto the image bearing member;

an intermediate transfer member facing to the image bearing member at a transfer portion;

a first electrode provided on a downstream side of the transfer portion with respect to the movable direction of said intermediate transfer member, said first electrode applying to the intermediate transfer member an electric potential having an opposite polarity to the polarity of the toner image formed on the image bearing member to transfer the toner image onto the intermediate transfer member; and a second electrode provided on an upstream side of the transfer portion with respect to the moveable direction of said intermediate transfer member, said second electrode applying to the intermediate transfer member an electric potential having the same polarity as the polarity of said toner image;

wherein the surface resistance of said intermediate transfer member is in a range of $10^7$ to $10^9$ Ω, a distance between said second electrode and a point at which said image bearing member starts to contact with said intermediate transfer member with respect to the movable direction of the intermediate transfer member is in a range of 5 to 40 mm, the bias voltage applied by said first electrode is in a range of +500 to +3000 V, and the bias voltage applied by said second electrode is in a range of −1000 to −2000 V.

2. The image forming apparatus as claimed in claim 1, wherein said distance is in a range of 5 to 25 mm, and the bias voltage applied by said first electrode is in a range of +1000 to +2500 V.

3. An image forming apparatus comprising:

an image bearing member;

an image forming means for forming a toner image onto the image bearing member;

a transfer device for transferring the toner image formed on the image bearing member onto a transfer medium at a transfer portion;

a transporting path for transporting the transfer medium to the transfer portion; and bias applying means provided on the transporting path at an upstream side of said transfer portion with respect to a direction of transportation of the transfer medium, said bias applying means applying to the transfer medium a voltage of the same polarity as the toner image as well as of higher potential than a surface potential of the image bearing member.

4. An image forming apparatus comprising:

an image bearing member;

an image forming means for forming a toner image onto the image bearing member;

an intermediate transfer member;

a first transfer member provided at a first transfer portion, said first transfer member applying to the intermediate transfer member a voltage of a polarity opposite to the polarity of the toner image formed on the image bearing member to transfer the toner image onto the intermediate transfer member at the first transfer portion;

a second transfer member provided at a second transfer portion, said second transfer member applying to a transfer medium a voltage of a polarity opposite to the polarity of the toner image transferred on the intermediate transfer member to transfer the toner image onto the transfer medium at the second transfer portion; and a third transfer member facing the second transfer member through the intermediate transfer member, said third transfer member, when said second transfer member applies the voltage to the transfer medium, applying to the intermediate transfer member a voltage of a polarity opposite to the polarity of the toner image transferred on the intermediate transfer member, wherein the voltage applied by said second transfer member is at least 800 V greater than the voltage applied by said third transfer member.

5. The image forming apparatus as claimed in claim 4, wherein the voltage applied by said third transfer member is 500 V or more but less than 2000 V.

6. The image forming apparatus as claimed in claim 5, wherein the voltage applied by said third transfer member is 1000 V or more but less than 2000 V.

7. The image forming apparatus as claimed in claim 4, wherein the voltage applied by said second transfer member is less than 4000 V.

8. The image forming apparatus as claimed in claim 4, wherein said second transfer device includes a transfer roller pressure contacting with the intermediate transfer member.

9. An image forming apparatus comprising:

an image bearing member;

an image forming means for forming a toner image onto the image bearing member;

an intermediate transfer member;

a first transfer device for transferring the toner image formed on the image bearing member to the intermediate transfer member at a first transfer portion; and a second transfer device for transferring the toner image transferred on the intermediate transfer member to a transfer medium at a second transfer portion;

a first bias voltage applying means facing the second transfer device through the intermediate transfer member, the first bias applying means applying to the intermediate transfer member a voltage of a polarity opposite to the polarity of toner image;

a second bias voltage applying means for applying to said second transfer device a voltage of an opposite polarity to the toner image; and a recharger provided on an upstream side of the second transfer portion with respect to moving direction of the intermediate transfer member, the recharger applying voltage of the same polarity as the toner image to the intermediate transfer member.

10. The image forming apparatus-as claimed in claim 9, wherein said second transfer device includes a transfer roller pressure contacting with the intermediate transfer member.

11. An image forming apparatus comprising:

an image bearing member;

an image forming means for forming a toner image onto the image bearing member;

an intermediate transfer member;

a first transfer device for transferring the toner image formed on the image bearing member to the intermediate transfer member at a first transfer portion; and a second transfer device for transferring the toner image transferred on the intermediate transfer member to a transfer medium at a second transfer portion;

a transporting path for transporting the transfer medium to the second transfer portion; and a bias applying means provided on the transporting path at an upstream side of said second transfer portion with respect to a direction of transportation of the transfer medium, said bias applying means applying to the transfer medium a voltage of the same polarity as the toner image and of higher potential than a surface potential of the intermediate transfer member at the second transfer portion.

12. The image forming apparatus as claimed in claim 11 further comprising a recharger which applies a voltage of the same polarity as the polarity of the toner image to the intermediate transfer member at an upstream side of the second transfer portion with respect to the moving direction of the intermediate transfer member.

13. The image forming apparatus as claimed in claim 11, wherein said second transfer device includes a transfer roller pressure contacting with the intermediate transfer member.

* * * * *